US007055606B2

(12) United States Patent
Goode et al.

(10) Patent No.: US 7,055,606 B2
(45) Date of Patent: Jun. 6, 2006

(54) SYSTEM AND METHOD FOR TREATING WELLS

(75) Inventors: Peter A. Goode, London (GB); Claude J. Vercaemer, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 175 days.

(21) Appl. No.: 10/760,332

(22) Filed: Jan. 20, 2004

(65) Prior Publication Data

US 2005/0155764 A1 Jul. 21, 2005

(51) Int. Cl.
*E21B 43/00* (2006.01)

(52) U.S. Cl. ..... 166/369; 166/107

(58) Field of Classification Search ..... 166/369, 166/65.1, 107, 305.1
See application file for complete search history.

(56) References Cited

U.S. PATENT DOCUMENTS

| | | | | |
|---|---|---|---|---|
| 2,980,184 | A | 4/1961 | Reed | |
| 3,765,484 | A * | 10/1973 | Hamby et al. | 166/278 |
| 4,267,888 | A | 5/1981 | Singer | |
| 4,450,907 | A | 5/1984 | Clark et al. | |
| 4,453,597 | A | 6/1984 | Brown et al. | |
| RE32,866 | E | 2/1989 | Cruise | |
| 4,934,460 | A * | 6/1990 | Coronado | 166/386 |
| 5,000,264 | A * | 3/1991 | Snider | 166/372 |
| 5,117,913 | A * | 6/1992 | Themig | 166/310 |
| 5,845,709 | A | 12/1998 | Mack et al. | |
| 6,260,627 | B1 | 7/2001 | Rivas | |
| 6,502,634 | B1 * | 1/2003 | Evans et al. | 166/250.03 |
| 6,508,308 | B1 | 1/2003 | Shaw | |
| 6,729,410 | B1 | 5/2004 | Steele | |
| 2004/0154800 | A1 | 8/2004 | Jack et al. | |

OTHER PUBLICATIONS

PHOENIX, A Schlumberger Company catalog; "Auto Y-Tool"; Scotland.

* cited by examiner

*Primary Examiner*—William Neuder
(74) *Attorney, Agent, or Firm*—Robert A. VanSomeren; Bryan P. Galloway; Jaime A. Castono

(57) ABSTRACT

A system and method is provided for utilizing both a wellbore completion and a formation treatment system. The formation treatment system comprises a bypass that directs well treatment fluid around the wellbore completion. The bypass protects the wellbore completion from potentially corrosive or erosive well treatment fluids which, in turn, allows the wellbore completion to remain downhole during the introduction of well treatment fluids.

21 Claims, 4 Drawing Sheets

SYSTEM AND METHOD FOR TREATING WELLS

BACKGROUND

In a variety of subterranean environments, such as wellbore environments, downhole completions are used to facilitate the production of desired fluids. For example, completions often are utilized in the production of fluids, such as petroleum, water and gas. The completion is located in a wellbore, and the fluids are pumped or otherwise produced to a desired location.

Well treatments sometimes are used before, during or after the production of fluids to affect well characteristics. For example, a well treatments may comprise well stimulation in which fluids are pumped downhole to stimulate subsurface formations. Due to the corrosive and/or erosive characteristics of some of these stimulation fluids, the well completion can be damaged if not removed prior to treatment.

SUMMARY

In general, the present invention provides a system and methodology to facilitate subsurface formation treatment. The approach utilizes a diverter and a bypass to direct treatment fluids around the completion components as the treatment fluids are flowed to the desired formation region. Thus, completion equipment may remain in the wellbore during stimulation or other treatment of subsurface formations without incurring damage from the treatment fluids.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for utilization and treatment of wells. The system and method render compatible a variety of downhole completions and well treatment systems. However, the devices and methods of the present invention are not limited to use in the specific applications that are described herein.

Figure 1:
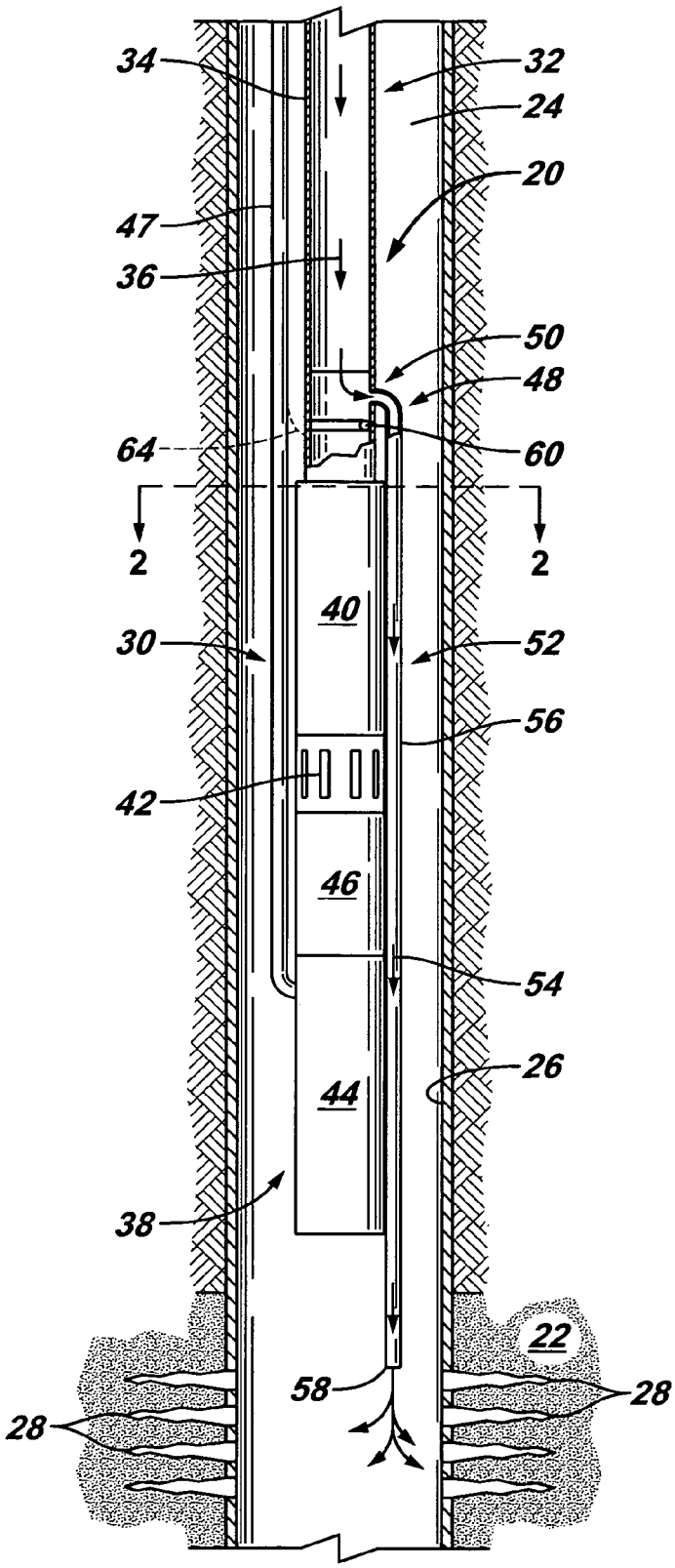
FIG. 1 is a schematic illustration of a system for producing fluid and treating a subsurface formation, according to an embodiment of the present invention.

Referring generally to FIG. 1, a system 20 is illustrated according to an embodiment of the present invention. System 20 is disposed in a subterranean environment, such as a subsurface formation 22 currently or previously holding fluids, e.g. petroleum, water and/or gas. As illustrated, a wellbore 24 is formed, typically by drilling, in formation 22. The wellbore 24 may be lined with a casing 26 having perforations 28. Perforations 28 provide a passage for fluid flowing from formation 22 into wellbore 24 or for treatment fluids flowing from wellbore 24 into formation 22.

System 20 comprises a completion 30 deployed at a desired location in wellbore 24 by a deployment system 32. Deployment system 32 may comprise a tubing 34, such as production tubing or coil tubing. Tubing 34 defines an internal flow path 36 along which fluids can be directed toward or away from completion 30.

Although completion 30 may have a variety of configurations, one example is an electric submersible pumping system 38 used to produce fluids from formation 22 through tubing 34 to a desired collection point. Electric submersible pumping system 38 may be constructed with a variety of components and component arrangements depending on the specific application. By way of example, however, the electric submersible pumping system may comprise a pump 40, a pump intake 42, an electric motor 44 and a motor protector 46. Motor 44 powers pump 40 which draws fluid from wellbore 24 through pump intake 42. As the fluid is pumped, additional fluid from formation 22 flows into wellbore 24 through perforations 28. Electrical power may be supplied to motor 44 by an appropriate power cable 47.

System 20 also comprises a well treatment system 48. Treatment system 48 utilizes a diverter valve 50 and a bypass 52 for directing fluid to a specific region of the wellbore. For example, bypass 52 may be used to route treatment fluids past completion 30. Bypass 52 defines a flow path 54 that may be disposed within a conduit 56. Conduit 56 may be in the form of a shroud or a tube, such as that illustrated in FIGS. 1–3. Conduit 56 extends from diverter valve 50 to a discharge outlet 58. In the embodiment illustrated, diverter valve 50 is disposed in tubing 34 above or on the downstream side of completion 30, and discharge outlet 58 is disposed below or on the upstream side of completion 30. Thus, the potentially corrosive or erosive well treatment fluids can be directed past completion 30 via conduit 56 to avoid detrimental contact between the well treatment fluid and the completion.

Figure 2:
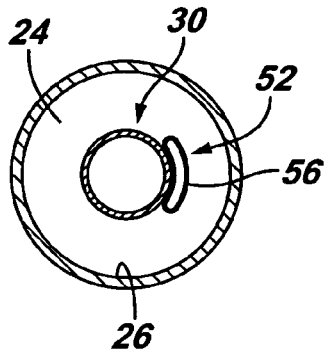
FIG. 2 is a cross-sectional view taken generally along line 2—2 of FIG. 1.

As further illustrated in FIG. 1, conduit 56 may be disposed between completion 30 and casing 26. Increased conservation of wellbore space can be achieved by placing conduit 56 adjacent the exterior surface of completion 30, as illustrated in FIG. 2. Additionally, the cross-sectional shape of conduit 56 can be elongated and/or wrapped about the exterior surface of completion 30 to further reduce the annular space required by bypass 52 (see FIG. 2).

Diverter valve 50 may comprise a variety of valve types depending on the specific application and design parameters. For example, diverter valve 50 may comprise a ball valve or a flapper valve. Diverter valve 50 is adjustable between at least two positions that alternately enable the downflow of well treatment fluids through tubing 34 and bypass 52, as illustrated in FIG. 1, and the upflow of fluids produced by completion 30 through tubing 34, as illustrated in FIG. 3.

In FIG. 1, diverter valve 50 is illustrated in a first position 60 in which fluids flowing downwardly through tubing 34 are blocked from reaching completion 30. Instead, the well treatment fluids are diverted into conduit 56 and directed past completion 30. The well treatment fluids are discharged from bypass 52 at discharge outlet 58 to accomplish the desired well treatment. For example, well stimulation fluids may be directed through bypass 52 and into wellbore 24 proximate perforations 28 to facilitate the flow of stimulation fluid from wellbore 24 into formation 22.

Figure 3:
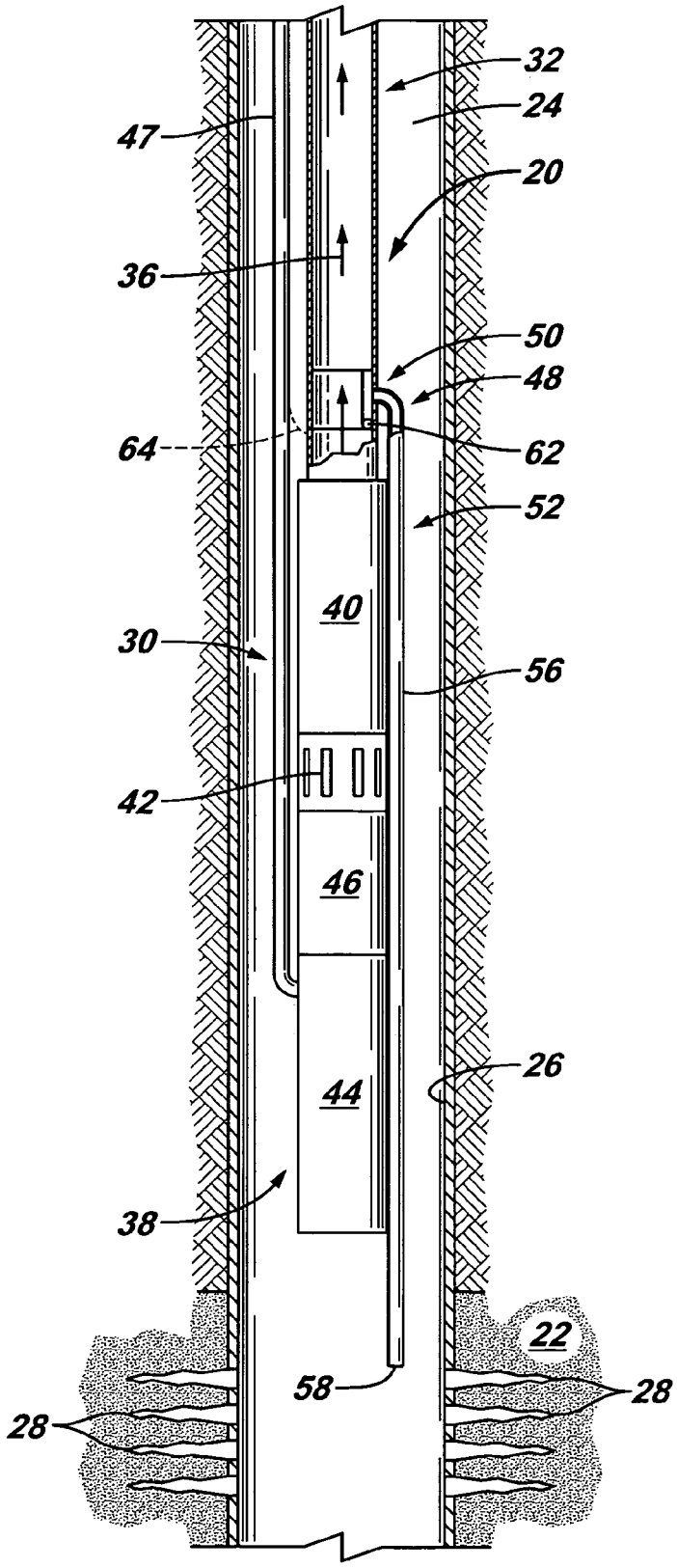
FIG. 3 is a schematic illustration similar to FIG. 1 with the system in a fluid producing configuration, according to an embodiment of the present invention.

In FIG. 3, diverter valve 50 is illustrated in a second position 62 in which fluids flowing upwardly through tubing 34 from completion 30 are blocked from entering bypass 52. Thus, well fluids that collect in wellbore 24 are readily produced to a desired collection point without interference from bypass 52.

Actuation of diverter valve 50 may be accomplished in a variety of ways depending on the design and application of the valve. For example, diverter valve 50 may be a simple flapper valve having a flapper that is moved between the first and second positions 60, 62 by fluid flow. In other words, the downward flow of well treatment fluid in tubing 34 can be used to move diverter valve 50 to the first position 60 in which flow to completion 30 through tubing 34 is blocked (see FIG. 1). Similarly, the upward flow of fluid produced by completion 30 through tubing 34 can be used to move the valve to its second position 62 in which flow to bypass 52 is blocked (see FIG. 3). Alternatively, diverter valve 50 may be controlled by inputs received through a control line 64. Control line 64 may be used to provide, for example, hydraulic or electrical inputs that actuate diverter valve 50 between at least first position 60 and second position 62.

Figure 4:
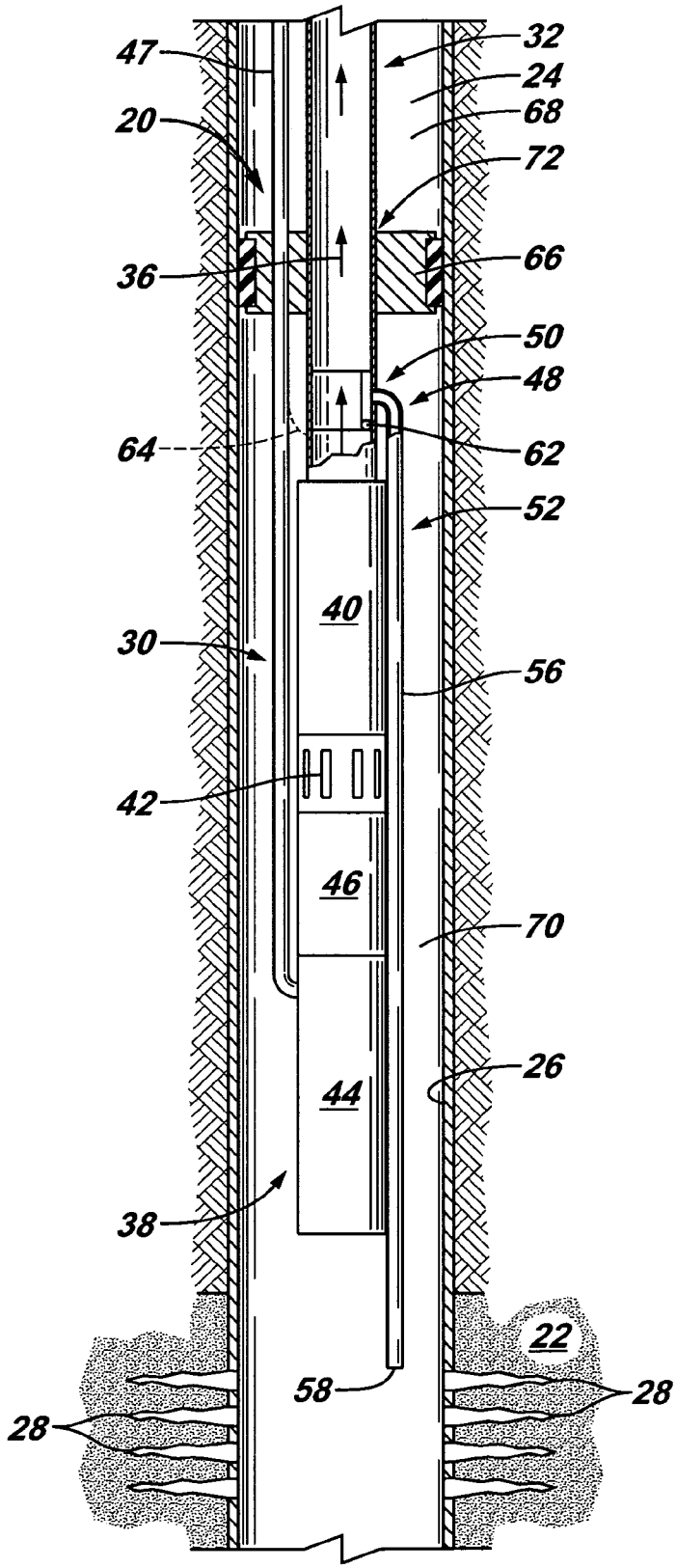
FIG. 4 is a schematic illustration of an alternate embodiment of the system illustrated in FIG. 1.
Figure 5:
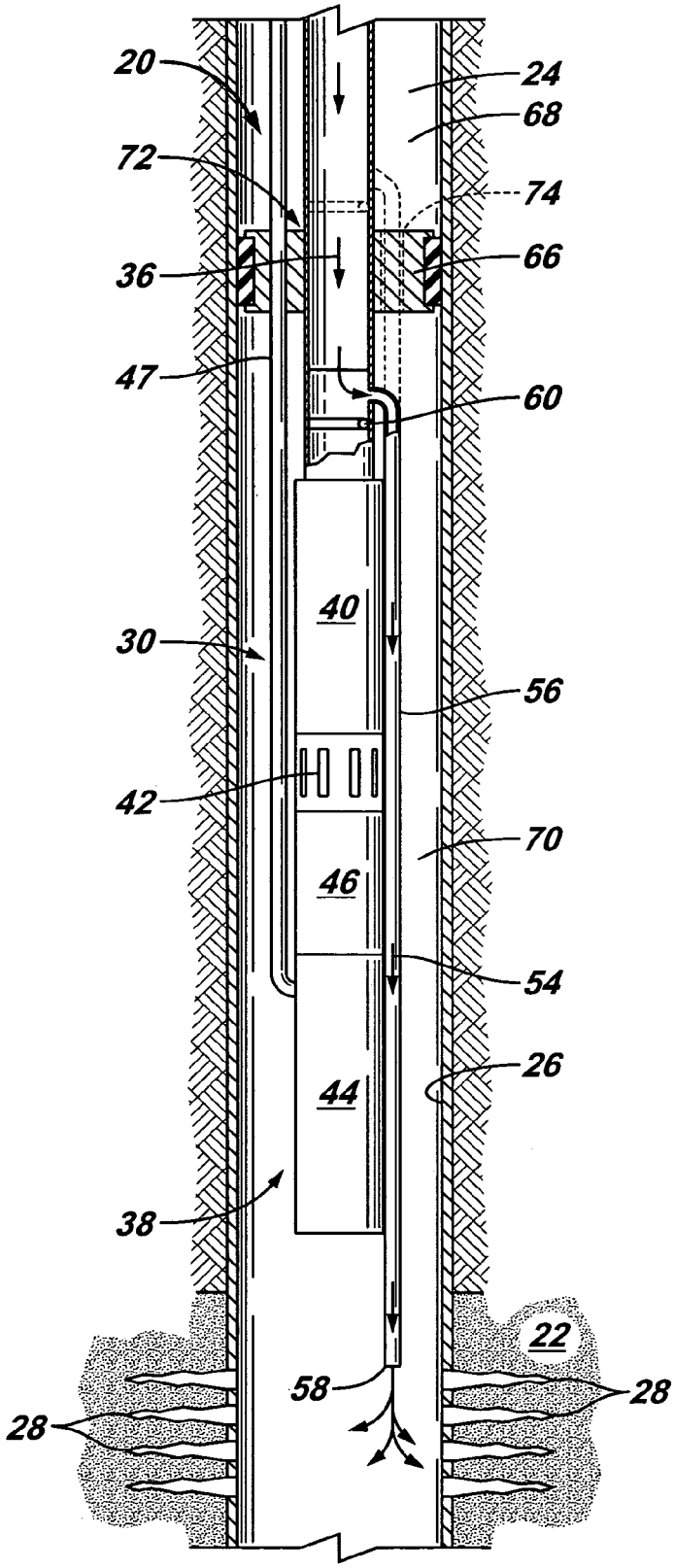
FIG. 5 is an illustration similar to that of FIG. 4 with the system in a well treatment configuration.

An alternate embodiment of system 20 is illustrated in FIGS. 4 and 5. In this embodiment, completion 30 further comprises one or more packers 66 used to divide the wellbore into zones. For example, in the illustrated embodiment, a single packer 66 is used to divide wellbore 24 into an upper zone 68 and a lower zone 70. In this embodiment, the electric submersible pumping system 38 is disposed in lower zone 70 and is operable to displace fluids from the lower zone through a passage 72 in packer 66 via tubing 34, as illustrated in FIG. 4. Also, well treatment fluids may be injected downwardly through packer 66, via passage 72 and tubing 34, and into bypass 52, as illustrated in FIG. 5. Alternatively, packer 66 may be formed with a secondary passageway 74 to enable passage of well stimulation fluids through packer 66, as illustrated by dashed lines in FIG. 5. In this latter embodiment, diverter valve 50 is placed on a side of packer 66 opposite that of electric submersible pumping system 38.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A well system, comprising:

a completion positioned in a wellbore to pump a production fluid, the completion comprising an electric submersible pumping system;

a tubing coupled to the completion;

a bypass coupled to the tubing for carrying a well treatment fluid past the completion; and a diverter valve disposed in cooperation with the tubing and the bypass to selectively direct either flow of the well treatment fluid through the tubing to the bypass or flow of production fluid from the completion through the tubing.

2. The well system as recited in claim 1, wherein the tubing comprises production tubing.

3. The well system as recited in claim 1, wherein the bypass composes a conduit that directs fluid past the completion.

4. The well system as recited in claim 3, wherein the conduit comprises a tube.

5. The well system as recited in claim 1, wherein the diverter valve comprises a flapper valve.

6. The well system as recited in claim 1, wherein the diverter valve is movable between a first position blocking flow through the tubing and a second position blocking flow through the bypass.

7. A well system, comprising:

a completion positioned in a wellbore to pump a production fluid;

a tubing coupled to the completion;

a bypass coupled to the tubing for carrying a well treatment fluid past the completion;

a diverter valve disposed in cooperation with the tubing and the bypass to selectively direct either flow of the well treatment fluid through the tubing to the bypass or flow of production fluid from the completion through the tubing; and a packer, wherein the bypass is connected to the tubing at a position below the packer.

8. A method of treating a subsurface formation, comprising:

locating a diverter valve in a tubing through which a fluid is produced;

engaging a treatment fluid flow path with the tubing;

utilizing the diverter valve to obstruct flow in the tubing while enabling flow along the treatment fluid flow path;

actuating the diverter valve to remove the obstruction in the tubing and to block flow along the treatment fluid flow path; and producing fluid through the tubing with a submersible pump powered by a motor.

9. The method as recited in claim 8, further comprising pumping a treatment fluid through a portion of the tubing and then along the treatment fluid flow path.

10. The method as recited in claim 8, further comprising coupling a completion to the tubing.

11. The method as recited in claim 10, wherein coupling comprises coupling an electric submersible pumping system to the tubing.

12. The method as recited in claim 10, wherein actuating comprises moving a flapper from a position closing the tubing to a position closing the treatment fluid flow path.

13. The method as recited in claim 10, wherein engaging comprises connecting a bypass tube to the tubing to direct a treatment fluid past the completion.

14. A system for pumping fluid in a wellbore with a completion deployed in the wellbore on a tubing, comprising:

a diverter valve controllable to enable flow of a production fluid through the tubing; and a bypass conduit in fluid communication with the diverter valve to isolate the completion from well treatment fluid introduced through the diverter valve, wherein the bypass conduit comprises a tube extending from the diverter valve to a position past an opposite end of the completion.

15. The system as recited in claim 14, wherein the diverter valve is mounted to the tubing.

16. The system as recited in claim 15, further comprising a packer through which the tubing extends.

17. The system as recited in claim 15, wherein the diverter valve comprises a flapper movable for selective closure of the tubing string and the bypass conduit.

18. The system as recited in claim 14, further comprising a completion having a submersible pump powered by a submersible motor.

19. A system for treating a well, comprising:

means for producing a wellbore fluid, the means for producing comprising an electric submersible pumping system;

means for carrying the wellbore fluid or a well treatment fluid; and means for bypassing the means for producing when the well treatment fluid is introduced into the well.

20. The system as recited in claim 19, wherein the means for carrying comprises a tubing.

21. The system as recited in claim 19, wherein the means for bypassing comprises a diverter valve coupled to bypass conduit.

* * * * *